US006927356B2

(12) United States Patent
Sato et al.

(10) Patent No.: US 6,927,356 B2
(45) Date of Patent: Aug. 9, 2005

(54) ENCLOSED SWITCHGEAR

(75) Inventors: Shinji Sato, Tokyo (JP); Kenichi Koyama, Tokyo (JP); Masahiro Arioka, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/753,080

(22) Filed: Jan. 8, 2004

(65) Prior Publication Data

US 2004/0159635 A1 Aug. 19, 2004

(30) Foreign Application Priority Data

Jan. 17, 2003 (JP) ..... 2003-009151

(51) Int. Cl.[7] ..... H01H 33/66
(52) U.S. Cl. ..... 218/154; 218/120
(58) Field of Search ..... 218/7–14, 17, 218/120, 124, 126, 140, 154, 153, 78, 84, 92

(56) References Cited

U.S. PATENT DOCUMENTS 5,191,180 A * 3/1993 Kitamura et al. ..... 218/135
5,508,487 A * 4/1996 Smith et al. ..... 218/154
5,717,185 A * 2/1998 Smith ..... 218/154
5,723,839 A * 3/1998 Kozawa ..... 218/43
6,198,062 B1 * 3/2001 Mather et al. ..... 218/152

FOREIGN PATENT DOCUMENTS

| | | |
|---|---|---|
| DE | 100 24 356 C1 | 10/2001 |
| JP | 9-147700 | 6/1997 |
| JP | 09-147700 | 6/1997 |

* cited by examiner

*Primary Examiner*—Lincoln Donovan
*Assistant Examiner*—M. Fishman
(74) *Attorney, Agent, or Firm*—Leydig, Voit & Mayer, Ltd.

(57) ABSTRACT

In a switchgear, oscillation of a moving current-carrying shaft and a moving contact of a vacuum valve is minimized, offset load on the contact surface is reduced, and friction the portion supporting the moving current-carrying shaft is reduced. A vacuum valve is disposed in a gas tank, one end of a moving current-carrying shaft integrally includes a moving contact of the vacuum valve, and a contact pressure adjusting spring is disposed on the other end of the moving current-carrying shaft. An operating rod extends through the gas tank, an operation mechanism is mounted on the operating rod outside the gas tank, an insulating rod is mounted inside the gas tank, and the contact pressure adjusting spring is joined to the insulating rod.

5 Claims, 6 Drawing Sheets

ENCLOSED SWITCHGEAR

BACKGROUND OF THE INVENTION

1. Field of the Invention

The present invention relates to an enclosed switchgear in which a vacuum valve provided with a pair of switching contacts and a moving mechanism part for moving the vacuum valve are disposed in a gas tank filled with an insulating gas.

2. Description of the Related Art

Hitherto, electric wiring has been connected and disconnected by a vacuum circuit breaker (as disclosed in, for example, the Japanese Patent Publication (unexamined) No. 1997-147700 (pages 1 to 5, FIGS. 1 to 7)). In this conventional vacuum circuit breaker disclosed in the Japanese Patent Publication (unexamined) No. 1997-147700, all members such as vacuum valve, insulating rod, contact pressure adjusting spring are left open to the atmospheric air.

However, in such a case the all the members are left open (exposed) to the air, in order to secure a predetermined dielectric breakdown voltage, the entire switchgear becomes unavoidably large in size, and humidity in the air and foreign matter contained in the air often stick to the surface of the insulating rod. As a result, such a trouble as malfunction is caused by decrease in insulation resistance of the surface of the insulating rod.

To cope with such a trouble, it may be an idea that the entire enclosed type switchgear is miniaturized by disposing a set of electric circuit parts, which is one of the members forming the conventional vacuum circuit breaker, in a gas tank and effectively preventing decrease in insulation resistance of the insulating rod surface. When installing the mentioned conventional vacuum circuit breaker with its form unchanged in a gas tank, enclosed type switchgear of a construction as shown in FIG. 7 can be obtained.

Referring to FIG. 7, reference numeral 1 is a gas tank filled with insulating gas, and numeral 2 is a vacuum valve disposed in the gas tank 1 and fixed by a member not shown. The vacuum valve 2 is provided with a stationary switching contact 4 and a moving switching contact 5 forming a pair in a housing 3 thereof. Numeral 8 is a stationary current-carrying shaft integrally provided with the stationary contact 4 of the vacuum valve 2, numeral 9 is a moving current-carrying shaft integrally provided with the moving contact 5 of the vacuum valve 2, and both of the current-carrying shafts 8 and 9 extend through and protrude out of the housing 3. A wiring of a main circuit not shown is connected to the stationary current-carrying shaft 8, and another wiring of a main circuit not shown is connected to the moving current-carrying shaft 9 through a flexible conductor 10.

Numeral 11 is an insulating rod fixed on the other end side of the moving current-carrying shaft 9. This insulating rod 11 transmits operation force from an operation mechanism part 18 described later to the moving contact 5 of the vacuum valve 2 and electrically insulates between the moving current-carrying shaft 9 and a contact pressure adjusting spring 19.

Numeral 14 is an arc shield covering the pair of contacts 4, 5, and numeral 15 is a guide part formed on the housing 3 so that the moving current-carrying shaft 9 extends through and is supported by the guide part 15. Numeral 16 is a bellows for keeping airtightness in the vacuum valve 2.

Numeral 17 is an operating rod disposed so as to extend through a guide part 20 formed on the gas tank 1, and numeral 18 is the operation mechanism part provided on the operating rod 17 outside the gas tank 1. Numeral 19 is the contact pressure adjusting spring disposed on the operating rod 17 inside the gas tank 1. This contact pressure adjusting spring 19 presses the contact 5 on the contact 4 with appropriate pressure to bring the contacts 4, 5 of the vacuum valve 2 into a closed electrode state. This contact pressure adjusting spring 19 is joined to the mentioned insulating rod 11.

It is to be noted that, in the case of constituting the enclosed type switchgear by disposing the conventional vacuum circuit breaker with its form unchanged in the gas tank 1, the insulating rod 11 is directly fixed to the moving current-carrying shaft 9. Further, in this constitution, the contact pressure adjusting spring 19 is mounted on the operating rod 17 and the mentioned spring 19 is joined to the insulating rod 11. As a result, the mentioned moving current-carrying shaft 9, including the vacuum valve 2 and the stationary current-carrying shaft 8, is kept at a state of being applied with a high-voltage. Meanwhile, the contact pressure adjusting spring 19 is insulated by the insulating rod 11 and is therefore kept at ground potential, including the operating rod 17, the operation mechanism part 18, and the gas tank 1 wall face.

In the mentioned construction, when the contacts 4, 5 of the vacuum valve 2 are in an opened electrode state and the operation mechanism part 18 is operated from this state to drive the operating rod 17 rightward in the drawing, driving force is transmitted to the moving current-carrying shaft 9 through the contact pressure adjusting spring 19 and the insulating rod 11. As a result, the contacts 4, 5 of the vacuum valve 2 are brought into the closed electrode. Therefore, an electric current flows through the main circuit through, for example, the stationary current-carrying shaft 8, the contacts 4, 5 of the vacuum valve 2, the moving current-carrying shaft 9, and the flexible conductor 10. On the other hand, when the operation mechanism part 18 is operated to drive the operating rod 17 leftward in the drawing, the contacts 4, 5 of the vacuum valve 2 are brought into the opened electrode, thus the electric current flowing through the main circuit being interrupted.

However, the enclosed type switchgear constructed by disposing the conventional vacuum circuit breaker with its form unchanged in the gas tank 1 as shown in FIG. 7 has the following problems.

That is, one end of the operating rod 17 is supported on the operation mechanism part 18, and the other end of the operating rod 17 is supported on the guide part 20 of the gas tank 1, therefore the operating rod 17 supported at such two points hardly oscillates vertically along the direction perpendicular to the shaft direction.

On the other hand, the moving current-carrying shaft 9 is supported only at the middle thereof by the guide part 15 formed on the housing 3 of the vacuum valve 2, and the moving contact 5 faces the stationary contact 4 on one end side of the moving current-carrying shaft 9, and the other end of the moving current-carrying shaft 9 is joined to the flexible contact pressure adjusting spring 19 through the insulating rod 11. Owing to such a structure, the members from the insulating rod 11 through the moving current-carrying shaft 9 to the moving contact 5 as a whole are easy to oscillate along the direction perpendicular to the shaft direction with the guide part 15 of the vacuum valve 2 acting as the supporting point. As a length L2 from the insulating rod 11 to the moving contact 5 is longer, the members as a whole oscillate more.

As described above, in the case that oscillation amount of the members from the insulating rod 11 through the moving current-carrying shaft 9 to the moving contact 5 is large as a whole, there is an increase in offset load on the surface of the contacts 4, 5 of the vacuum valve 2 and an increase in friction force on the guide part 15 on which the moving current-carrying shaft 9 is supported. The increase in the offset load causes an increase in contact resistance on the surface of the contacts 4, 5 of the vacuum valve 2, eventually resulting in a power loss. Moreover, when increasing the friction force on the guide part 15, more operation force is required for the operation mechanism part 18, which obstructs smooth operation.

If the moving current-carrying shaft 9 is shortened in length, the length L2 from the insulating rod 11 to the moving contact 5 is also shortened, and it is possible to decrease the oscillation amount. However, in actual construction, it is necessary to attach the flexible conductor 10 and various members not shown in the middle of the moving current-carrying shaft 9. While securing a space for these members, achieving a large reduction in length of the moving current-carrying shaft 9 is not always easy, thus there is a limit in the shortening.

SUMMARY OF THE INVENTION

The present invention was made to solve the above-discussed problems and has an object of providing an enclosed type switchgear in which oscillation amount of a moving current-carrying shaft and a moving contact of a vacuum valve is minimized, offset load on the surface of the contacts is reduced, and friction force at the portion on which the moving current-carrying shaft is supported is reduced.

To accomplish the foregoing object, in an enclosed type switchgear according to the invention: a vacuum valve provided with a pair of switching contacts is disposed in a gas tank filled with insulating gas; one end side of a moving current-carrying shaft is integrally coupled with a moving contact of the mentioned vacuum valve; and a contact pressure adjusting spring is disposed on the other end side of this moving current-carrying shaft. An operating rod is disposed extending through the mentioned gas tank; an operation mechanism part performing switching operation of the vacuum valve is mounted on the mentioned operating rod located outside the gas tank; an insulating rod is mounted on the mentioned operating rod located inside the gas tank; and the mentioned insulating rod electrically insulates between the operating rod and the mentioned contact pressure adjusting spring; and the mentioned contact pressure adjusting spring is joined to the mentioned insulating rod.

In the enclosed type switchgear of above construction, only the moving current-carrying shaft and the moving contact are located on the vacuum valve side from the flexible contact pressure adjusting spring without any insulating rod. Therefore, length of the members from the moving current-carrying shaft to the moving contact is shortened as a whole. As a result, oscillation amount of the moving current-carrying shaft and of the moving contact of the vacuum valve is reduced, offset load on the surface of the contacts is reduced, and friction force at the portion on which the moving current-carrying shaft is supported is reduced.

In the enclosed type switchgear according to the invention, the insulating rod is fixed to the operating rod and the contact pressure adjusting spring is directly mounted on one end of the moving current-carrying shaft. Therefore, only the moving current-carrying shaft and the moving contact are located on the vacuum valve side from the contact pressure adjusting spring. Consequently, length of the members from the one end side of the moving current-carrying shaft to the moving contact is shortened as a whole. As a result, not only the switchgear is further miniaturized but also oscillation amount of the moving current-carrying shaft and the moving contact of the vacuum valve is reduced, and offset load on the surface of the contacts is reduced. Therefore, power loss between the contacts is decreased. Furthermore, friction force at the portion on which the moving current-carrying shaft is supported is reduced and, consequently, the operation mechanism part can be operated with small operation force, resulting in improvement of operation performance with ease.

DETAILED DESCRIPTION OF THE INVENTION

Embodiment 1

Figure 1:
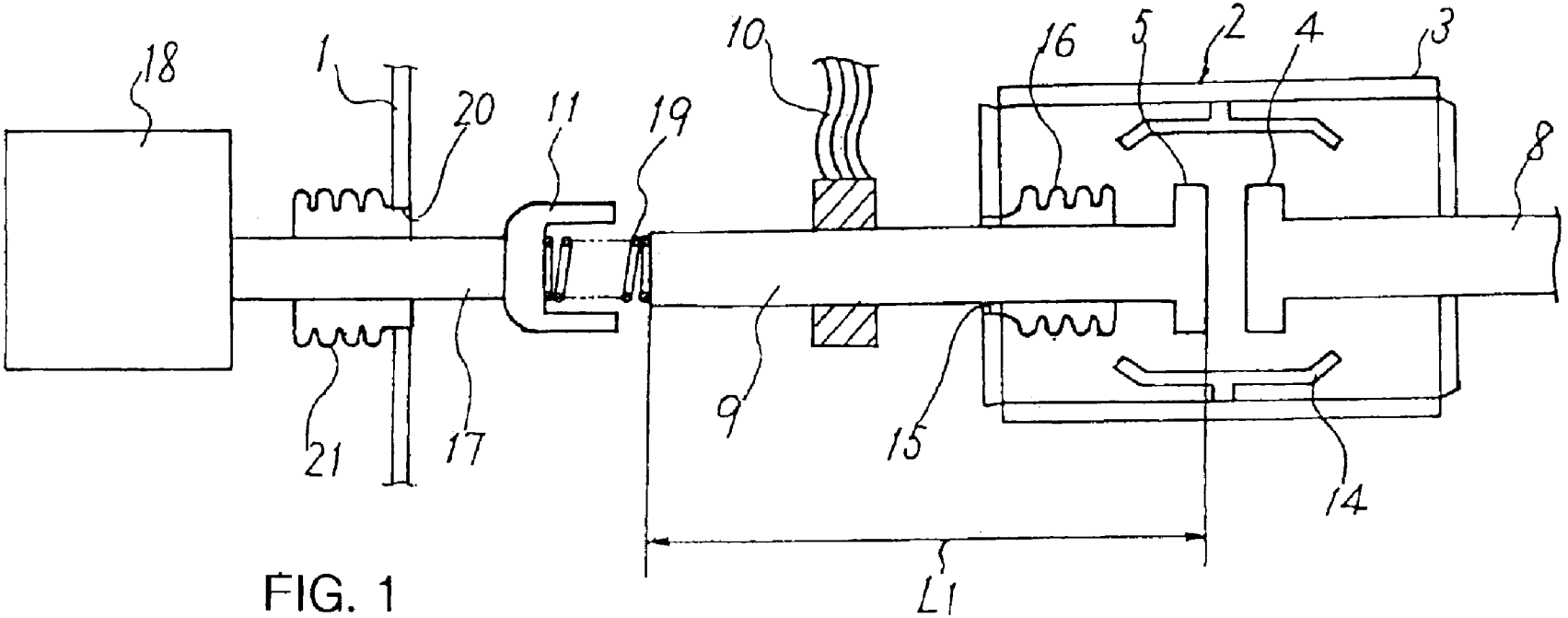
FIG. 1 is a schematic constitutional view showing enclosed type switchgear according to Embodiment 1 of the present invention.
Figure 2:
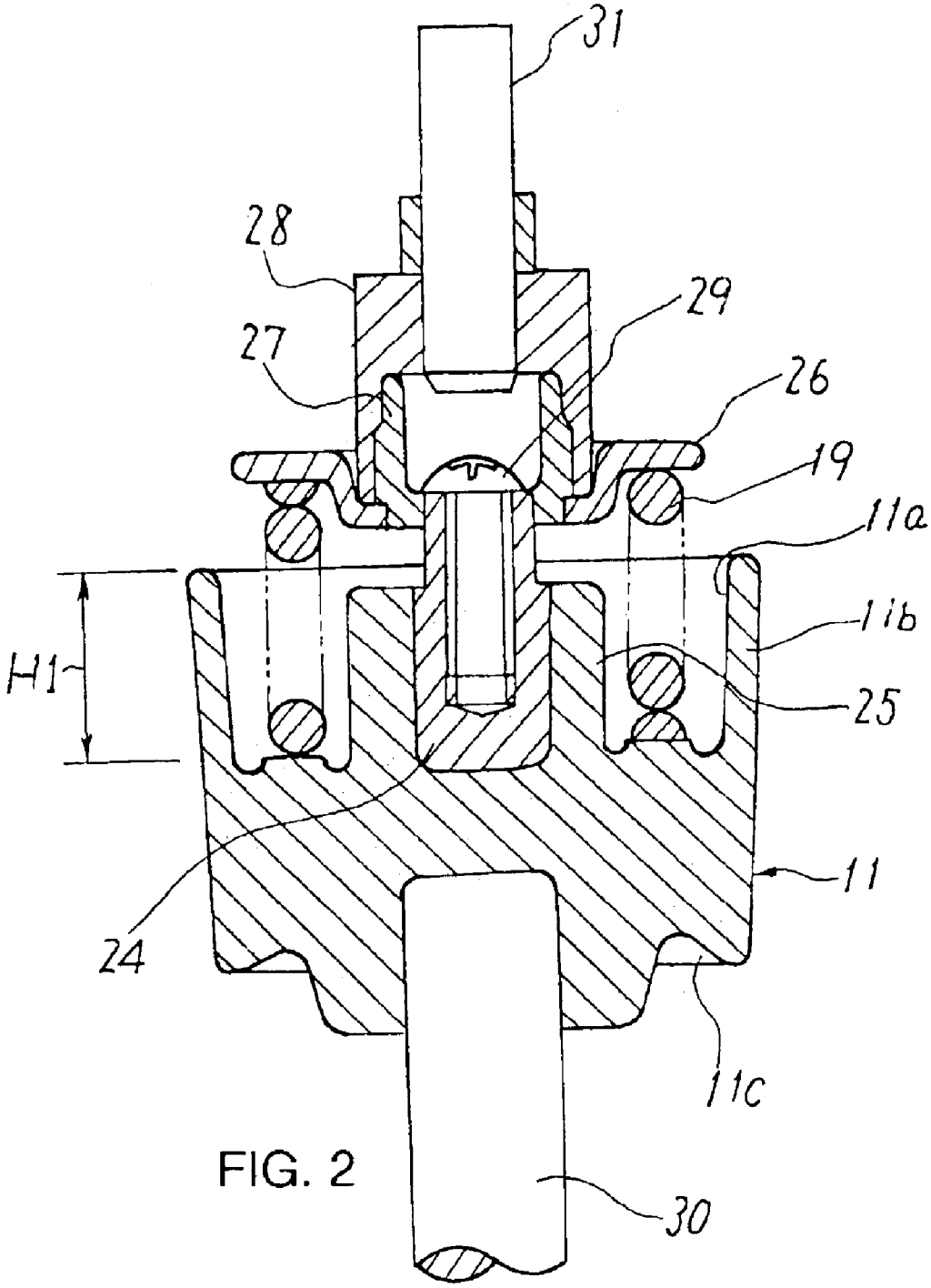
FIG. 2 is a sectional view showing a construction in the vicinity of an insulating rod picked out from the enclosed type switchgear in FIG. 1.
Figure 7:
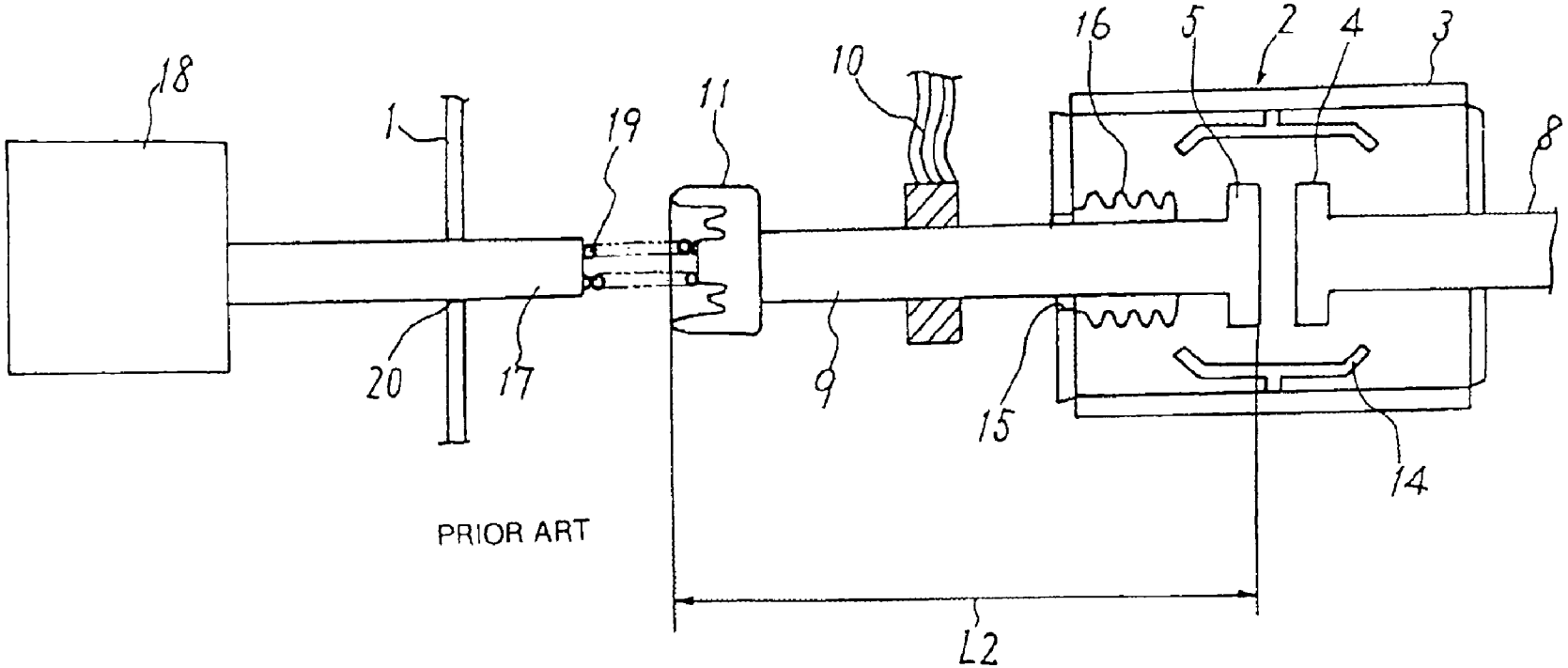
FIG. 7 is a schematic view in which enclosed type switchgear is constructed by disposing a conventional vacuum circuit breaker with its form unchanged in a gas tank.

FIG. 1 is a schematic view showing a construction of enclosed type switchgear according to Embodiment 1 of the invention, and FIG. 2 is a sectional view taking out the portion in the vicinity of an insulating rod. The same reference numerals are designated to like components shown in FIG. 7.

The enclosed type switchgear according to this Embodiment 1 has a gas tank 1, and this gas tank 1 is filled with insulating gas. In this example, the gas tank 1 is filled with the insulating gas, which is an atmospheric air without treatment at an arbitrary pressure in a range from 0.1 to 0.30 MPa.abs.

A vacuum valve 2 is disposed in the gas tank 1 and fixed by a member not shown. This vacuum valve 2 is provided with a stationary switching contact 4 and a moving switching contact 5 forming a pair in a housing 3. One end of a stationary current-carrying shaft 8 is integrally provided with the stationary contact 4 of the vacuum valve 2, and one end side of a moving current-carrying shaft 9 is integrally provided with the moving contact 5. Both of the current-carrying shafts 8 and 9 extend through and protrude from the housing 3. A wiring of a main circuit not shown is connected to the stationary current-carrying shaft 8, and a wiring of a main circuit not shown is connected to the moving current-carrying shaft 9 through a flexible conductor 10.

Furthermore, a contact pressure adjusting spring 19 is mounted on the other end side of the moving current-carrying shaft 9 and presses the contact 4 on the contact 5 with appropriate pressure when the contacts 4, 5 of the vacuum valve 2 are in the closed electrode state. Numeral 14 is an arc shield covering the pair of contacts 4, 5, and numeral 15 is a guide part formed on the housing 3 so that the moving current-carrying shaft 9 extend through the guide part 15 as well as is supported by the guide part 15. Numeral 16 is a bellows for keeping airtightness in the vacuum valve 2.

An operating rod 17 is disposed so as to extend through a guide part 20 formed on the gas tank 1, and a bellows for keeping airtightness in the gas tank 1 is mounted on the guide part 20. An operation mechanism part 18 for performing switching operation of the vacuum valve 2 is fixed on the operating rod 17 outside the gas tank 1, and an insulating rod 11 is fixed on the operating rod 17 inside the gas tank 1. This insulating rod 11 transmits operation force from the operation mechanism part 18 to the moving contact 5 of the vacuum valve 2 and electrically insulates between this operating rod 17 and the contact pressure adjusting spring 19. The insulating rod 11 is joined to the contact pressure adjusting spring 19.

In this Embodiment 1, the contact pressure adjusting spring 19 is directly mounted on the moving current-carrying shaft 9, and the insulating rod 11 is fixed to the operating rod 17. Looking from the vacuum valve 2 side to the operation mechanism part 18 side, it will be understood that the contact pressure adjusting spring 19 and the insulating rod 11 are disposed in reverse order as compared with those in the construction shown in FIG. 7. Therefore, high voltage (commercially available ac voltage) is kept applied on the contact pressure adjusting spring 19 together with the moving current-carrying shaft 9, the vacuum valve 2, and the stationary current-carrying shaft 8. On the other hand, the operating rod 17, the operation mechanism part 18, and the gas tank 1 wall face are kept at ground potential.

The contact pressure adjusting spring 19 is flexible. Accordingly, as for the portion from this contact pressure adjusting spring 19 to the moving contact 5 of the vacuum valve 2 on the right half of the drawing, the whole length of the members from the insulating rod 11 being in contact with the contact pressure adjusting spring 19 through the moving current-carrying shaft 9 up to the moving contact 5 is a length L2 in the construction shown in FIG. 7. On the other hand, the whole length of the members from the moving current-carrying shaft 9 being in contact with the contact pressure adjusting spring 19 up to the moving contact 5 is a length L1 in this Embodiment 1. Since the insulating rod 11 is not disposed on the right side of the flexible contact pressure adjusting spring 19 in this Embodiment 1, oscillation amount of the moving current-carrying shaft 9 and the moving contact 5 of the vacuum valve 2 is reduced by L2>L1.

As a result, offset load on the surfaces of the contacts 4, 5 of the vacuum valve 2 is reduced and contact resistance of the contacts 4, 5 is also reduced, eventually resulting in reduction in resistance loss at the time of application of power. Furthermore, friction force at the guide part 15 on which the moving current-carrying shaft 9 is supported is reduced, and consequently it becomes possible to put the operation mechanism part 18 into practical use even with small operation force.

In the case of constructing a vacuum circuit breaker in such a manner that the insulating rod 11 is left open to the atmospheric air as disclosed in the foregoing Japanese Patent Publication (unexamined) No. 1997-147700, there is a possibility that humidity in the air and foreign matter included in the air stick to the surface of the insulating rod 11, thereby deteriorating the insulation resistance.

On the other hand, in the enclosed type switchgear according to this Embodiment 1 of above construction, the insulating rod 11 is accommodated in the gas tank 1 and there is substantially no possibility of the humidity and foreign matter sticking to the insulating rod 11. It is therefore unnecessary to take any special care in view of maintenance of the surface insulation resistance. In other words, concerning the insulating rod 11 of the enclosed type switchgear, it is possible to pay an attention exclusively to improvement in dielectric breakdown voltage between high voltage and low voltage. From the foregoing viewpoint, this Embodiment 1 adopts a construction shown in FIG. 2 for the insulating rod 11.

The insulating rod 11 in this Embodiment 1 is composed of an insulator such as epoxy resin or polyester resin, and a metal high-voltage side conductor 24 is integrally embedded in this insulating-rod 11 on the upper side in the central axis thereof. Further, a metal low-voltage side connecting rod 30 joined integrally to the mentioned operating rod 17 is integrally embedded in the insulating rod 11 on the lower side thereof.

A circumferential groove 11*a* of a predetermined depth H1 is formed on the upper portion of the insulating rod 11 concentrically with the high-voltage side conductor 24, and the outside of this circumferential groove 11*a* is formed to serve as a cylindrical insulating barrier part 11*b*. Accordingly, this insulating barrier part 11*b* has a height H1 that is the same as the mentioned depth H1. The circumferential groove 11*a* for forming the insulating barrier part 11*b* opens upward, but this does not cause any problem because the whole insulating rod 11 is accommodated in the gas tank 1 and there is substantially no possibility of humidity and foreign matter sticking to the insulating rod 11. Furthermore, a pleat (fold part) 11*c* for securing a long creepage distance for insulation from the insulating barrier part 11*b* to the operating rod 17 is formed on the lower portion of the insulating rod 11.

The contact pressure adjusting spring 19 is disposed in the mentioned circumferential groove 11*a*. Further, a spring guide 25 is disposed on an inner wall face of the circumferential groove 11*a* to prevent of the insulating rod 11 from deformation or cracking due to positioning and spring reaction force of the contact pressure adjusting spring 19. Furthermore a spring retainer plate 26 is disposed on an upper end of the contact pressure adjusting spring 19 to keep the foregoing spring 19 at a predetermined length and produce appropriate spring reaction force. This spring retainer plate 26 is bolted and fixed onto the high-voltage side conductor 24 with a bolt 29 together with an inner fastening member 27 and an outer fastening member 28. Further, the other end part of a high-voltage side connecting rod 31 integrally connected to the mentioned moving current-carrying shaft 9 is screw-engaged with the outer fastening member 28.

Figure 3:
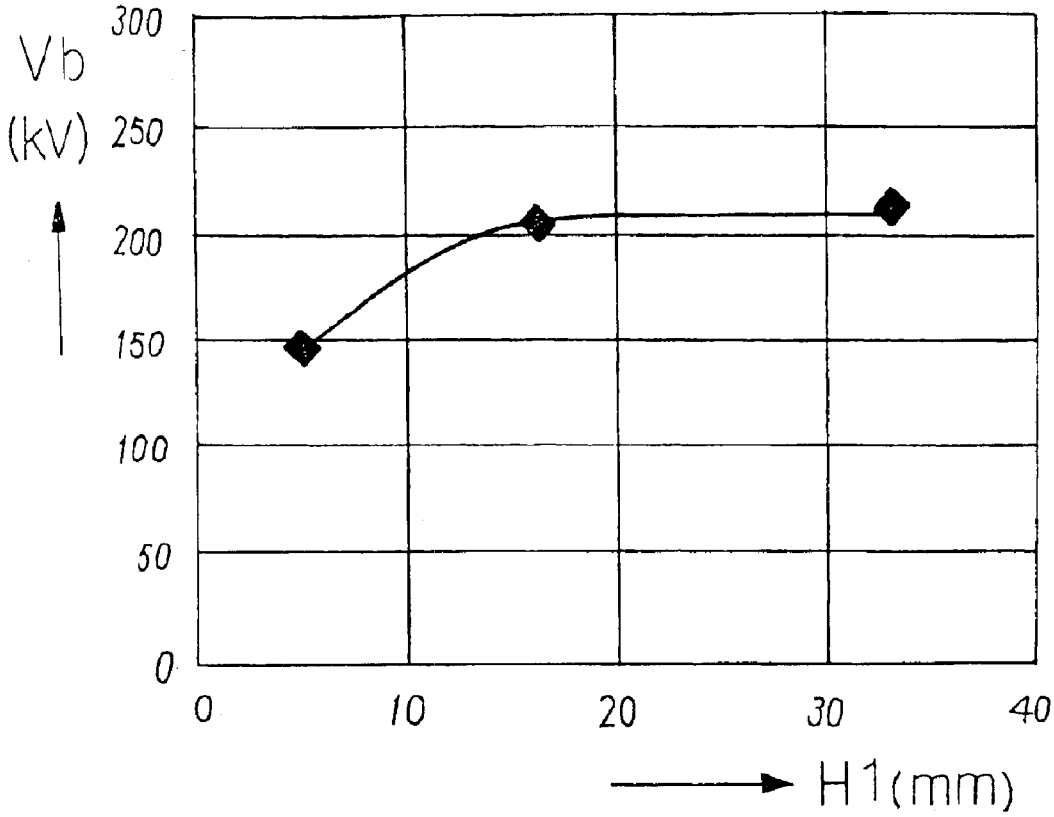
FIG. 3 is a characteristic diagram showing a relation between insulating barrier formed on the insulating rod shown in FIG. 2 and dielectric breakdown voltage.

FIG. 3 shows results of measuring the dielectric breakdown voltage Vb in the atmospheric air, in the case where the height H1 of the insulating barrier part 11*b* of the insulating rod 11 constructed as shown in FIG. 2 is changed in three stages.

It is understood from FIG. 3 that the breakdown voltage is 150 kV in the case where height H1 of the insulating barrier part 11*b* is 5 mm, and the breakdown voltage exceeds 200 kV in the case where the height H1 is 18 mm. In the case where the height H1 is 33 mm, the breakdown voltage is almost the same as that in the case of 18 mm, which means that the dielectric breakdown voltage is saturated to remain at a fixed value. A high electric field is generated at an end of the spring retainer plate 26, which may induce electrical discharge from the end of the spring retainer plate 26. However, development of the electrical discharge is restrained and the dielectric breakdown voltage rises on condition that the height H1 of the insulating barrier part 11*b* is set to an appropriate value. Although advantage of disposing the insulating barrier part 11*b* is recognized also in the case where H1 is less than 20 mm, the results shown in FIG. 3 suggests that it is preferable to dispose the height H1 to be not less than 20 mm.

In this manner, when setting the insulating barrier part 11*b* to be not less than 20 mm in height H1, withstand voltage performance of the insulating rod 11 is remarkably improved. Therefore, sufficient withstand voltage is secured by the insulating rod 11 even if the contact pressure adjusting spring 19 is directly mounted on the moving current-carrying shaft 9.

Figure 4A:
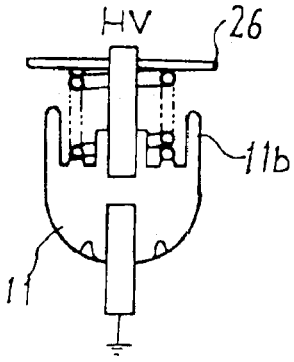
FIGS. 4(*a*) and 4(*b*) are front views each showing a state in which an outer diameter of a spring retainer plate for pressing a contact pressure adjusting spring is changed with respect to the outer diameter of the insulating barrier on the insulating rod.
Figure 4B:
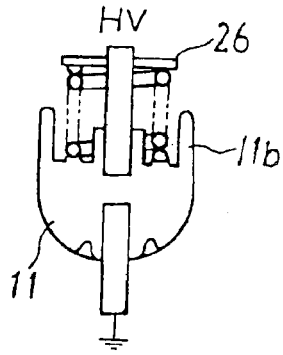
Figure 5:
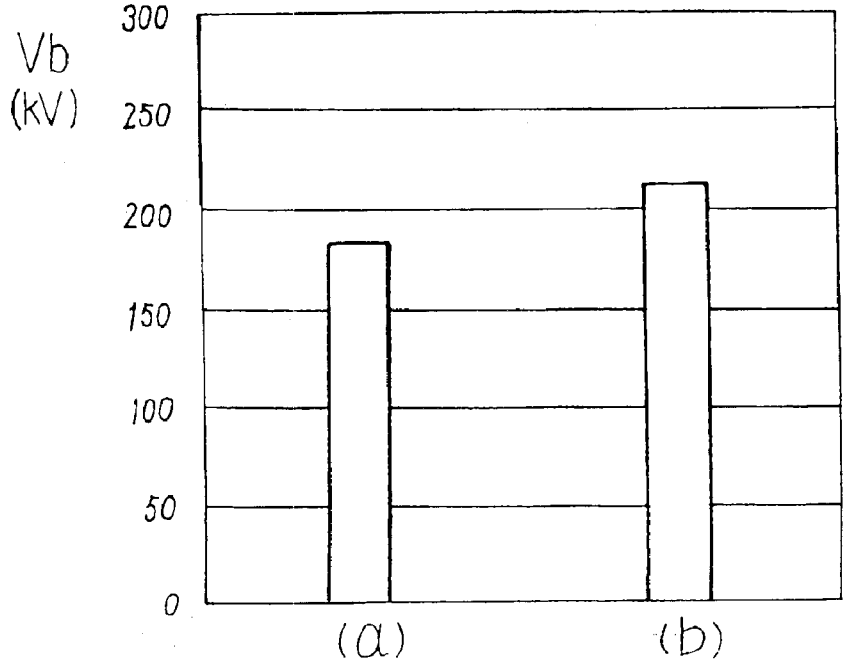
FIG. 5 is a characteristic graph showing a relation between the dielectric breakdown voltage and outer diameter of the spring retainer plate, in the case of changing the outer diameter of the spring retainer plate of the contact pressure adjusting spring disposed on the insulating rod.

FIG. 4(*a*) shows a case where outer diameter alone of the spring retainer plate 26 is changed to be larger than the inner diameter of the insulating barrier part 11*b*. FIG. 4(*b*) shows another case where outer diameter of the spring retainer plate 26 is changed to be smaller than inner diameter of the insulating barrier part 11*b*. FIG. 5 shows results of measuring the dielectric breakdown voltage Vb in the air in the cases where outer diameter of the spring retainer plate 26 is changed as shown in FIGS. 4(*a*) and (*b*). In this example, the insulating barrier part 11*b* is 20 mm in height H1.

It is understood from FIG. 5 that breakdown voltage is higher when outer diameter of the spring retainer plate 26 is smaller than inner diameter of the insulating barrier part 11*b*. This is because in the case where outer diameter of the spring retainer plate 26 is larger than inner diameter of the insulating barrier part 11*b*, electrical discharge from the end of the spring retainer plate 26 easily takes place and barrier effect is not sufficiently performed. On the contrary, electrical discharge from the end of the spring retainer plate 26 does not easily takes place in the case where outer diameter of the spring retainer plate 26 is smaller than inner diameter of the insulating barrier part 11*b*.

In this manner, the withstand voltage performance of the insulating rod 11 is remarkably improved by establishing outer diameter of the spring retainer plate 26 to be smaller than inner diameter of the insulating barrier part 11*b*. As a result, sufficient withstand voltage can be secured by the insulating rod 11 even if the contact pressure adjusting spring 19 is directly mounted on the moving current-carrying shaft 9 together with the advantages obtained by appropriately setting the height H1 of the insulating barrier part 11*b*.

Based on the foregoing Embodiment 1, the following variations and modifications may be made:

(1) The insulating rod 11 in the foregoing Embodiment 1 has a pleat 11*c* formed at a portion near the low-voltage side connecting rod 30 connected to the operating rod 17. In the case where the insulating rod 11 is required to have a high withstand voltage, it is preferable to provide such a pleat 11*c* in view of securing along creepage distance for insulation. It is also possible to omit formation of such a pleat 11*c* in the case where any very high withstand voltage is not required. Omitting formation of the pleat 11*c* makes it possible to simplify the structure and manufacture the insulating rod 11 with ease.

Figure 6:
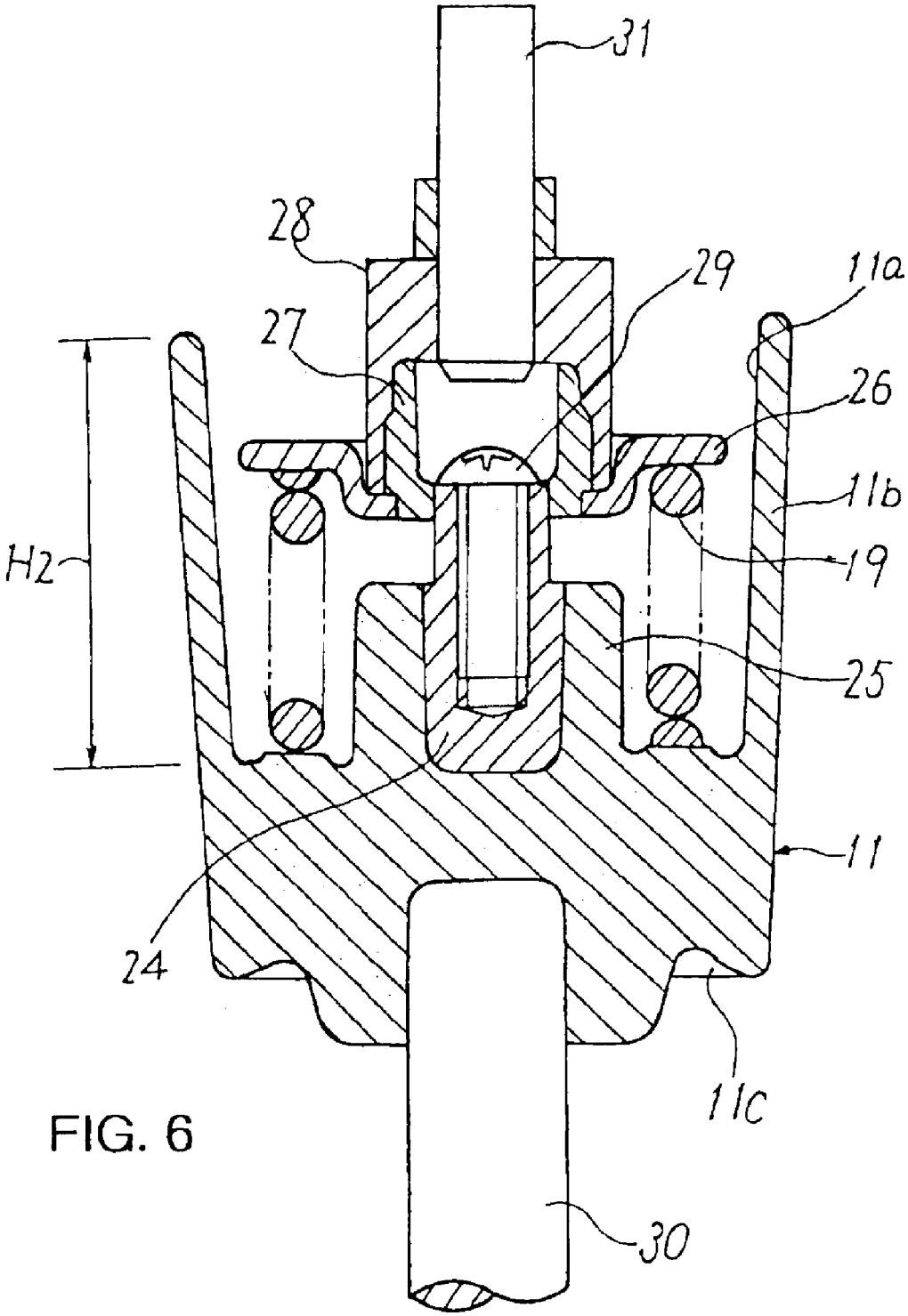
FIG. 6 is a sectional view showing a modification of the insulating rod.

(2) Besides the configuration of the insulating rod 11 shown in FIG. 2, another configuration shown in FIG. 6 is also applicable. The insulating rod 11 shown in FIG. 6 is disposed so that a height H2 of the insulating barrier part 11*b* extends in the shaft direction above the place on which the spring retainer plate 26 is mounted. Therefore, in this construction, the contact pressure adjusting spring 19 and the spring retainer plate 26 are both disposed in the insulating barrier part 11*b*. By employing this construction, most of the portion to which a high voltage is applied and electrical discharge takes place is covered with the insulating barrier 11*b* and, as a result, the withstand voltage performance is improved all the more.

(3) Although the bellows 21 is used to secure airtightness of the guide part 20 formed on the gas tank 1 wall face in the foregoing Embodiment 1, it is also preferable to adopt a construction in which an O ring is fitted to the guide part 20.

(4) Although air without treatment is used under pressure as the insulating gas filled into the gas tank 1 of this enclosed type switchgear in the foregoing Embodiment 1, it is also preferable to use any of atmospheric air with its water and/or dust removed, nitrogen gas, mixed gas of oxygen and nitrogen, and mixed gas of carbon dioxide and nitrogen. In this case, the gas pressure is at any arbitrary value in a range from 0.1 to 0.30 MPa.abs. All of these kinds of gas give no effect on or only an ignorable effect on greenhouse effect, and they are suitable because of their gentleness to what is called global environment.

Using electro-negative gas such as $SF_6$ (sulfur hexafluoride), c-$C_4F_8$, $C_2F_6$, or $C_3F_8$ brings about improvement in withstand voltage performance of the enclosed type switchgear as compared with the air and so on described above and exhibits an advantage of obtaining the enclosed type switchgear of high reliability. Furthermore, minimizing the influence on the greenhouse effect by mixing the foregoing electro-negative gas with nitrogen gas or the air brings an advantage of keeping suitable withstand voltage and being gentle to the global environment.

(5) The present invention is not limited to the construction described in the foregoing Embodiment 1, and it is a matter of course that various changes and modifications may be made without departing from the scope of the invention.

What is claimed is:

1. An enclosed switchgear comprising:

a vacuum valve including a pair of switching contacts and disposed in a gas tank filled with an insulating gas;

a moving current-carrying shaft, a first end of which is integrally coupled with a moving contact of said vacuum valve;

a contact pressure adjusting spring disposed on a second end of said moving current-carrying shaft;

an operating rod extending into the gas tank;

an operation mechanism part switching said vacuum valve, mounted on said operating rod, and located outside the gas tank; and an insulating rod mounted on said operating rod, located inside the gas tank and electrically insulating said operating rod from said contact pressure adjusting spring, wherein said contact pressure adjusting spring is joined to said insulating rod.

2. The enclosed switchgear according to claim 1, including an insulating barrier covering at least a part of an outer circumference of said contact pressure adjusting spring and integral with said insulating rod.

3. The enclosed switchgear according to claim 2, including a spring retainer plate for shortening and keeping said contact pressure adjusting spring to a predetermined length and mounted on said insulating rod, an outer diameter of said spring retainer plate being smaller than an inner diameter of said insulating barrier on said insulating rod.

4. The enclosed switchgear according to claim 1, wherein the gas tank is filled with the insulating gas at a pressure of 0.1 to 0.30 MPa.abs. and the insulating gas is selected from the group consisting of air without treatment, air from which at least one of water and dust have been removed, nitrogen, a mixture of oxygen and nitrogen, and a mixture of carbon dioxide and nitrogen.

5. The enclosed switchgear according to claim 1, wherein the gas tank is filled with the insulating gas at a pressure of 0.1 to 0.30 MPa.abs. and the insulating gas is selected from the group consisting of $SF_6$, c-$C_4F_8$, $C_2F_6$, and $C_3F_8$ mixed with one of nitrogen gas and air.

* * * * *